United States Patent [19]

Spitz

[11] Patent Number: 4,974,271

[45] Date of Patent: Dec. 4, 1990

[54] MOUNTING APPARATUS FOR WALL BEDS

[76] Inventor: Melvin P. Spitz, 619 N. Elm St., Beverly Hills, Calif. 90210

[21] Appl. No.: 143,374

[22] Filed: Jan. 12, 1988

[51] Int. Cl.[5] ..... A47C 17/40; A47C 17/46; A47C 17/48

[52] U.S. Cl. ..... 5/136; 5/164 R; 5/53 B

[58] Field of Search ..... 5/164 R, 164 B, 164 C, 5/133, 136, 53 B

[56] References Cited

U.S. PATENT DOCUMENTS

| | | | |
|---|---|---|---|
| 3,179,956 | 4/1965 | Bennett | 5/136 |
| 3,464,070 | 9/1969 | Driver | 5/136 |
| 3,550,167 | 12/1970 | Bennett | 5/164 R |

*Primary Examiner*—Alexander Grosz

[57] ABSTRACT

A wall bed is disclosed employing a linkage assembly which moves the wall bed outwardly from the wall cavity in a fashion so that the head end of the bed will not be in the wall cavity and the level of the mattress will be at a height which approximately corresponds to the height of conventional beds. There is also provided a counter balancing spring assembly employing an angle member which connects extension springs to the bed base so that they are contained within a compact structure which is received within the wall cavity. A headboard is also provided which may be tilted rearwardly or positioned at a right angle to the sleeping surface.

9 Claims, 10 Drawing Sheets

10
12
14
16
18
20
21
22
24
24a
24b
25
26
28
30
32
34a
34b
35
36
38
4
52
54
60
62
65
67
68
70
76
78
80
82
84
86
90
92
94
96
98
100
102
104
2

MOUNTING APPARATUS FOR WALL BEDS

BACKGROUND OF THE INVENTION

1. Field of the Invention

This invention relates to wall beds, and in particular a mounting apparatus for wall beds which moves the bed completely out of the wall and elevates it to the correct position above the floor. It includes a unique counter balancing spring assembly to facilitate easy opening and closing of the wall bed.

2. Background Discussion

Wall beds are conventional articles of manufacture which call for a rigid, non-folding bed to be mounted in a generally vertical position within a cavity in a wall and hinged at the lower end so that the bed can be moved from the vertical to the horizontal position. In some instances a cabinet-like structure is provided to house the bed with the underside of the bed base providing a cabinet front face when the bed is in the closed, vertical position.

It is highly desirable that the entire bed surface be moved outside of the cavity upon opening. In other words, that portion of the sleeping surface adjacent the pivotably mounted end of the wall bed desirably is moved outwardly from the cavity. When this is done, no portion of the sleeping surface of the bed is located in the cavity. This overcomes an objection of some users of wall beds who experience claustrophobia if they are required to sleep with their head, or another portion of their body, within the cavity. Also, it is desirable for the bed upon opening to be raised to an appropriate level where the top surface of the mattress will be at approximately the same distance from the floor as a conventional bed. Moreover, it is highly desirable for the wall bed to be easily opened and closed.

SUMMARY OF THE INVENTION

The present invention provides a way for wall beds to be mounted so that, upon opening, the entire sleeping surface of the wall bed is moved outwardly from the wall cavity containing it and raised to a sufficient height where the top surface of the mattress will be at approximately the same distance from the floor as a conventional bed, typically about 19 to about 21 inches. The present invention includes linkage means which achieves this movement of the bed, and a unique counter balancing spring assembly for facilitating opening and closing of the wall bed. This invention also includes an adjustable headboard.

There are several features of this invention which contribute to the desired attributes discussed above, no single one of which is solely responsible for these attributes. Without limiting the scope of this invention as expressed by the claims, its more prominent features will now be discussed briefly. After considering this discussion, and particularly after reading the section of this application entitled DETAILED DESCRIPTION OF THE PREFERRED EMBODIMENT, one will understand how the features of this invention provide its desirable attributes.

One feature of this invention is the use of a linkage assembly which connects the bed base to a mounting element within the wall cavity. The linkage assembly includes a plurality of lever arms which coact to pivot and move the bed base outwardly from the wall cavity to place the sleeping surface beyond the cavity and elevate the sleeping surface to the desired height above the floor when horizontal.

The second feature of this invention is a counter balancing spring assembly which acts to prevent the wall bed from falling heavily upon being opened and assists in closing the bed when it is desired to return the bed to the wall cavity. The characteristic feature of this counter balancing spring assembly is that it is compact so that it fits in the confined space in the wall cavity. This is accomplished by the use of a pivotably mounted angle arm with springs connected to it in a fashion that provides the counter balancing action.

BRIEF DESCRIPTION OF THE DRAWING

The preferred embodiment of this invention is illustrated in the drawing, wherein like numerals indicate like parts, and in which.

DETAILED DESCRIPTION OF THE PREFERRED EMBODIMENT

Figure 1:
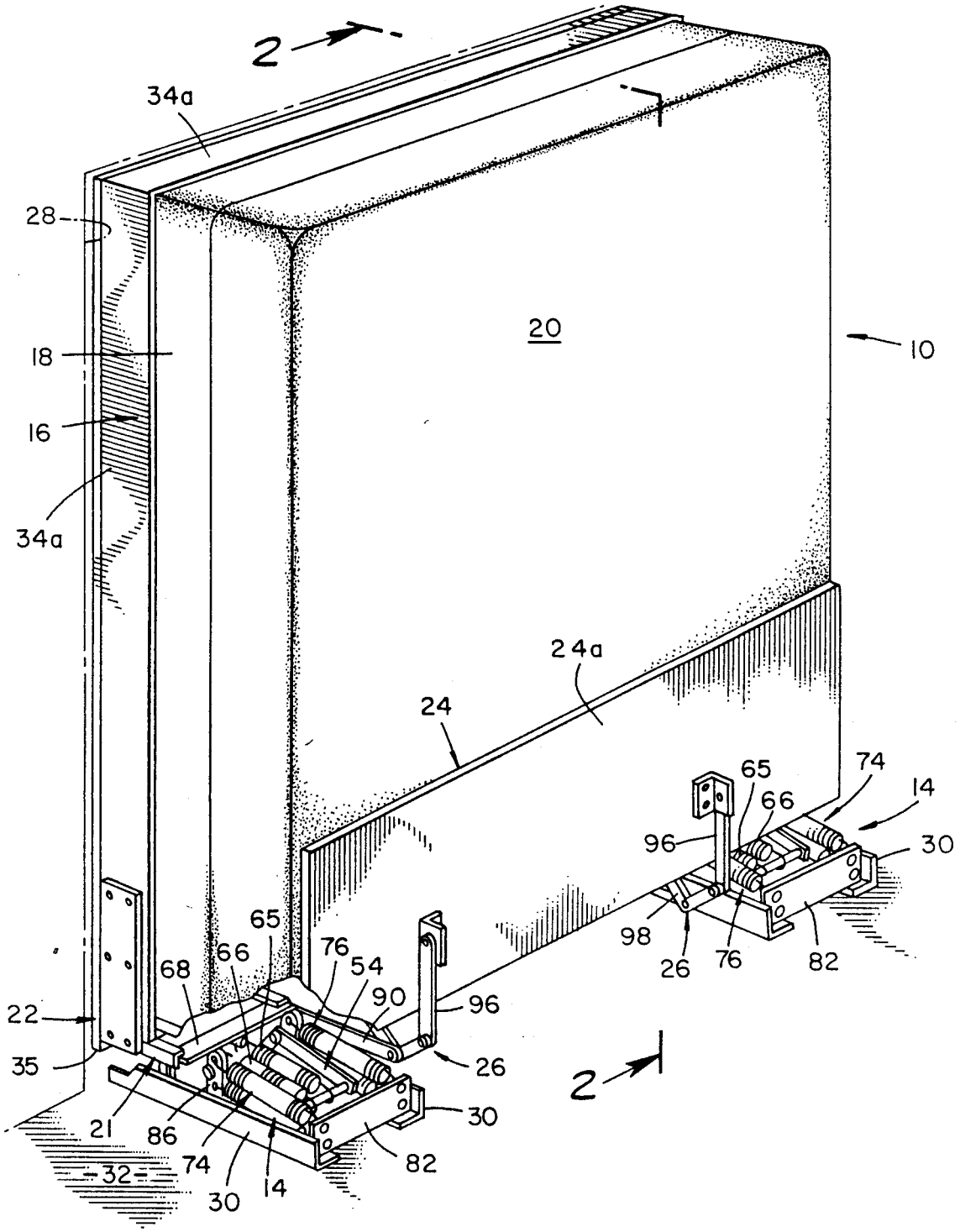
FIG. 1 is a perspective view of a closed wall bed employing the linkage and counter balancing spring assemblies of this invention.

As shown in FIG. 1, a typical wall bed 10 is equipped with the linkage assembly 12 and counter balancing spring assembly 14 of this invention. There are two linkage assemblies and two counter balancing spring assemblies mounted to the left and right hand lower sides of the wall bed 10.

Figures 8, 9:
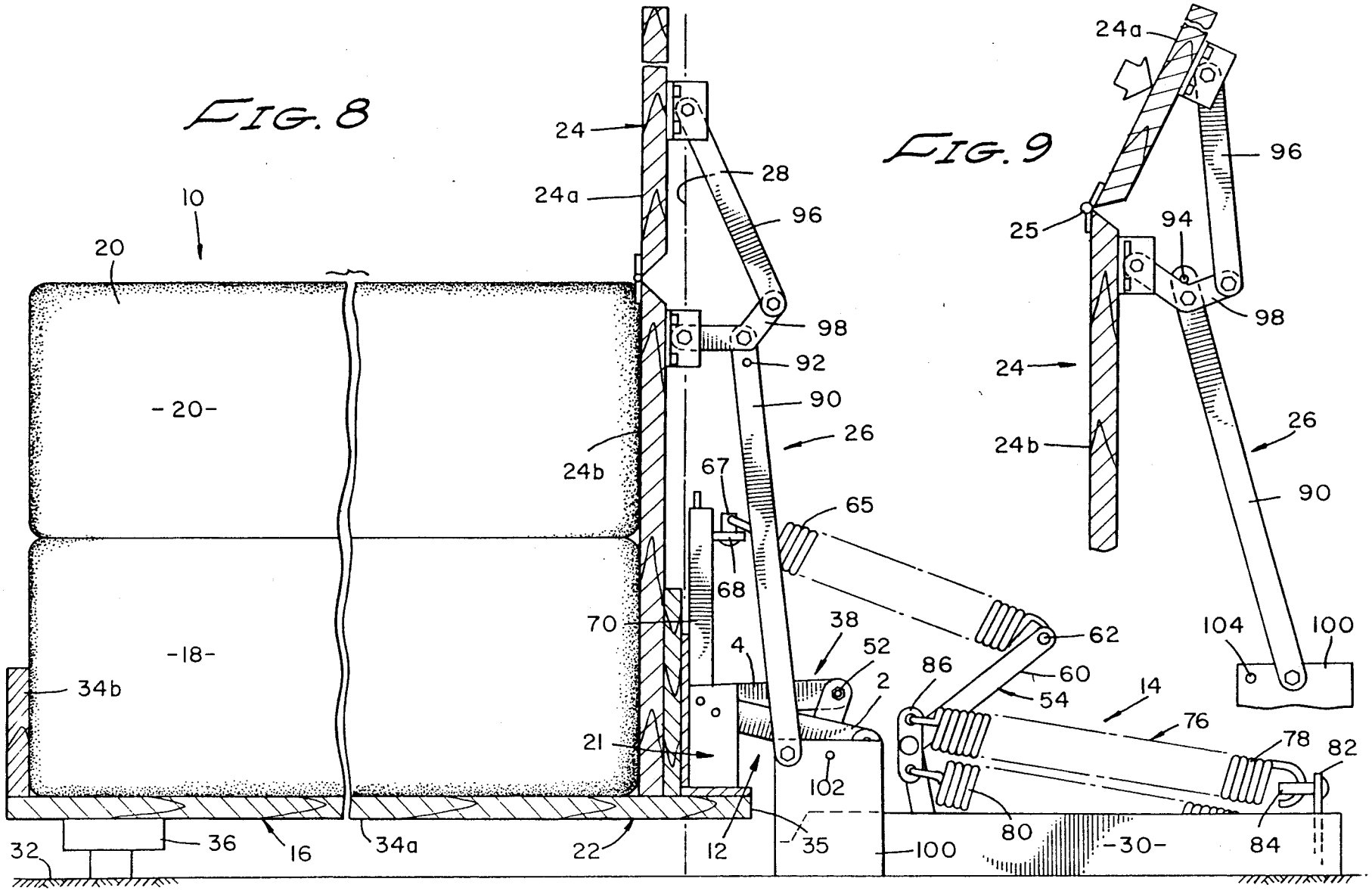
FIG. 8 is a fragmentary cross-sectional view showing the linkage and counter balancing spring assemblies with the bed in the fully opened position.
FIG. 9 is a fragmentary view showing the headboard actuator adjusted to tilt the headboard of the wall bed.

The wall bed 10 includes a bed base 16, a box spring 18, and mattress 20. The lower end section 22 of the bed base 16 is equipped with reinforcing plates 21 (only one shown) which are connected to the linkage assembly 12 and counter balancing spring assembly 14. The end section 22 has secured to it a headboard 24 having two sections **24*a* and 24*b* hingedly connected together by hinge 25 and equipped with a headboard actuator 26 that unfolds the two sections as the wall bed 10 is moved from the vertical position within the wall cavity 28 (shown in dotted lines in FIG. 1) and an open, horizontal position (FIG. 8). The linkage assembly 12 and counter balancing spring assembly 14 are mounted within the wall cavity 28 and each is secured to a mounting frame 30 attached to the floor 32**.

Figure 2:
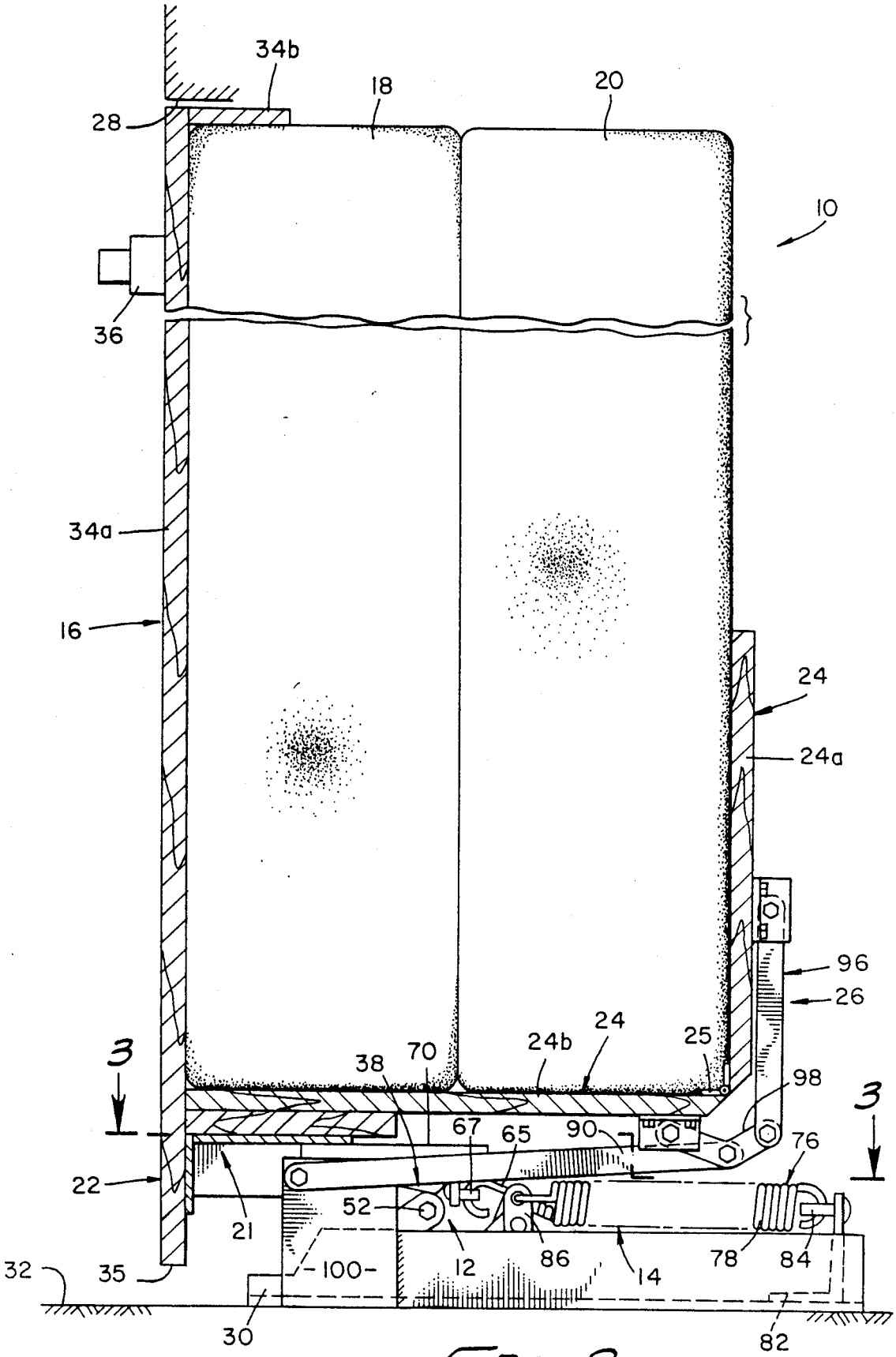
FIG. 2 is a cross-sectional view taken along line 2—2 of FIG. 1.

As best illustrated in FIG. 2, the bed base 16 comprises a flat wooden supporting member 34*a* having a framework 34*b* around its perimeter to contain the box spring 18. An end portion 35 of the supporting member 34*a*, which is adjacent the floor 32 when the wall bed 10 is closed, extends beyond the framework 34*b* to provide a site to attach a bracket assembly 21 to the bed base near the hinge zone. It is important that the end portion 35 extend to a point near the floor 32 to minimize the "gap" between this portion 35 and the floor.

The linkage assembly 12 and counter balancing assembly 14 are secured to the bracket assembly 21, which in turn is fixedly secured to the end portion 35 of supporting member 34*a* and to the reinforcing plate 24. A pair of projections 36 (only one shown) extend outwardly from the supporting member 34*a* to serve as handles for grasping the closed wall bed 10 and as legs which rest against the floor 32 when the bed is opened fully. The underside surface of supporting member 34*a* may be finished to provide a cabinet-matching or wall-matching exterior.

Figure 3:
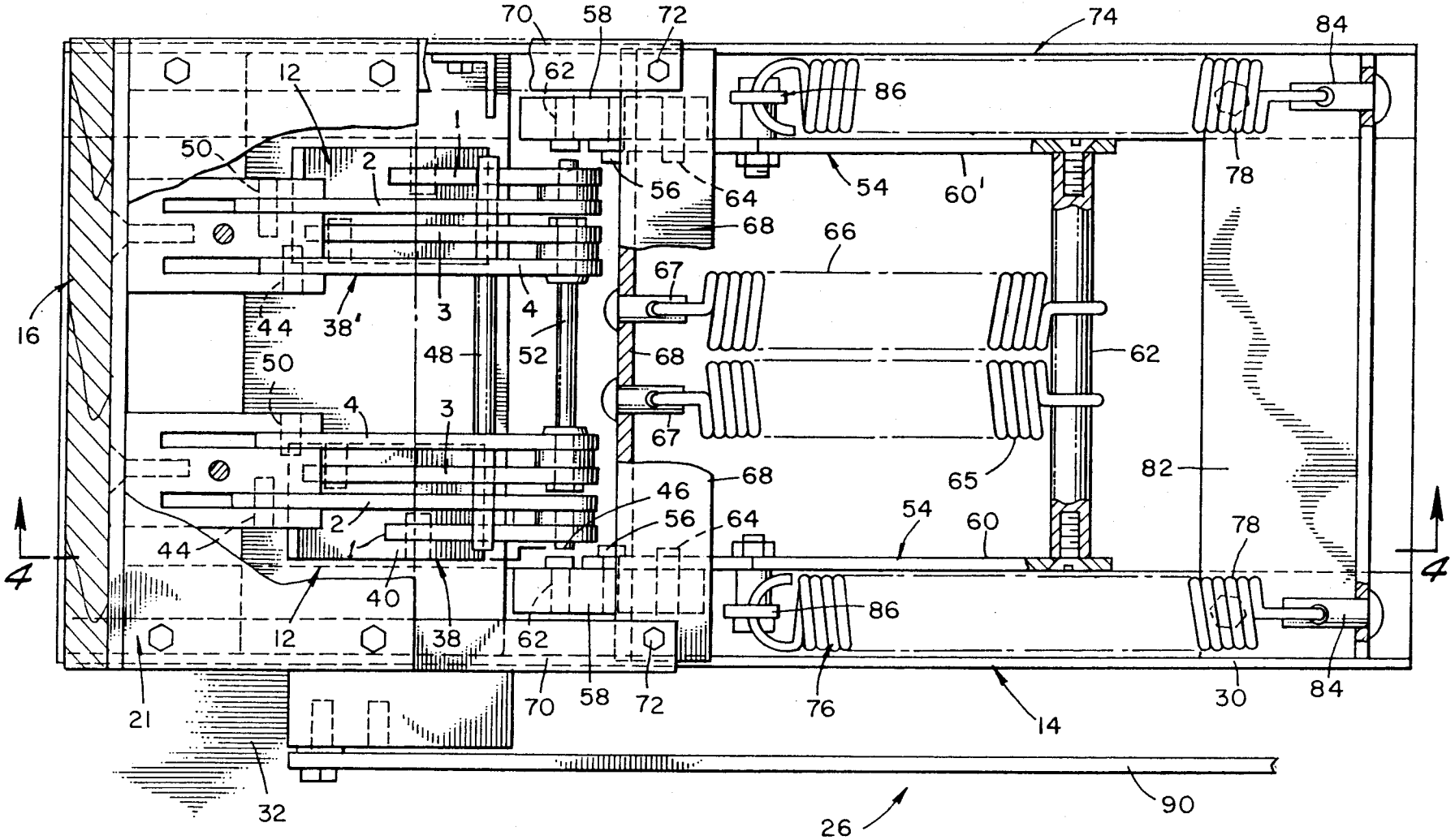
FIG. 3 is a cross-sectional view taken along line 3—of FIG. 2.
Figure 4:
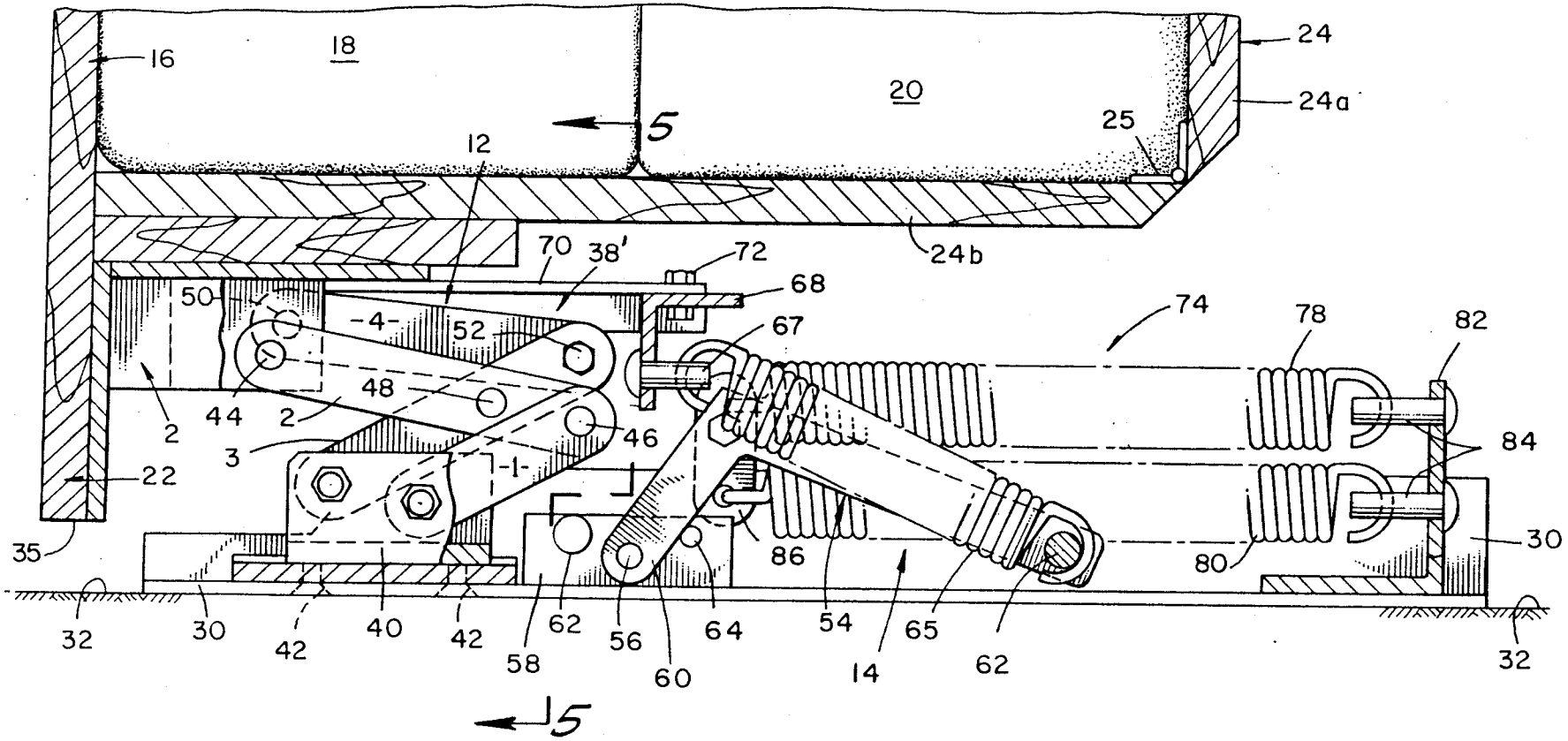
FIG. 4 is a cross-sectional view taken along line 4—4 of FIG. 3.
Figure 5:
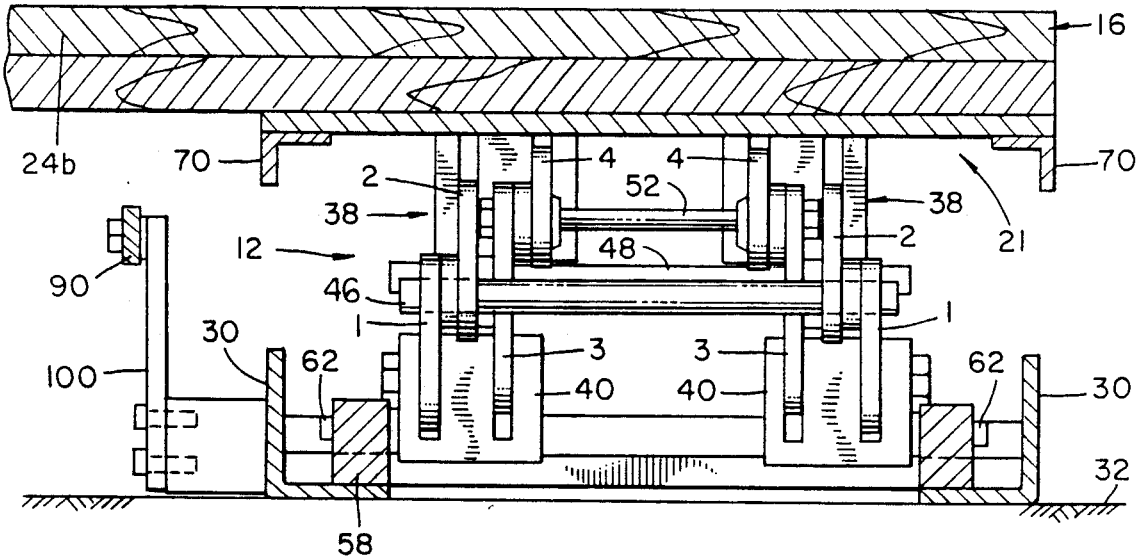
FIG. 5 is a cross-sectional view taken along line 5—5 of FIG. 4.
Figure 6:
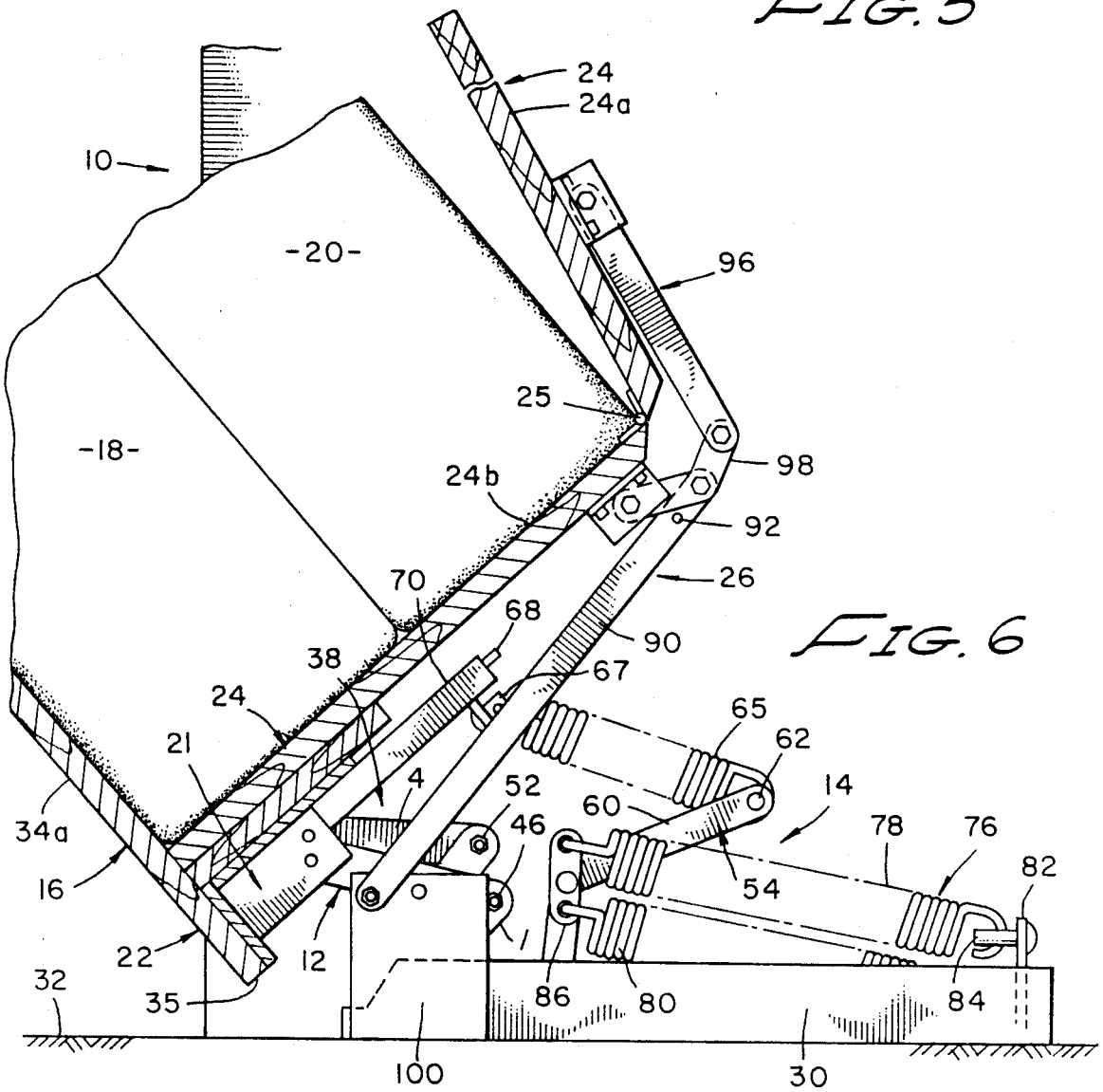
FIG. 6 is a fragmentary view in cross section showing the positions of the linkage and counter balancing spring assemblies as the wall bed is being opened or closed.
Figure 7:
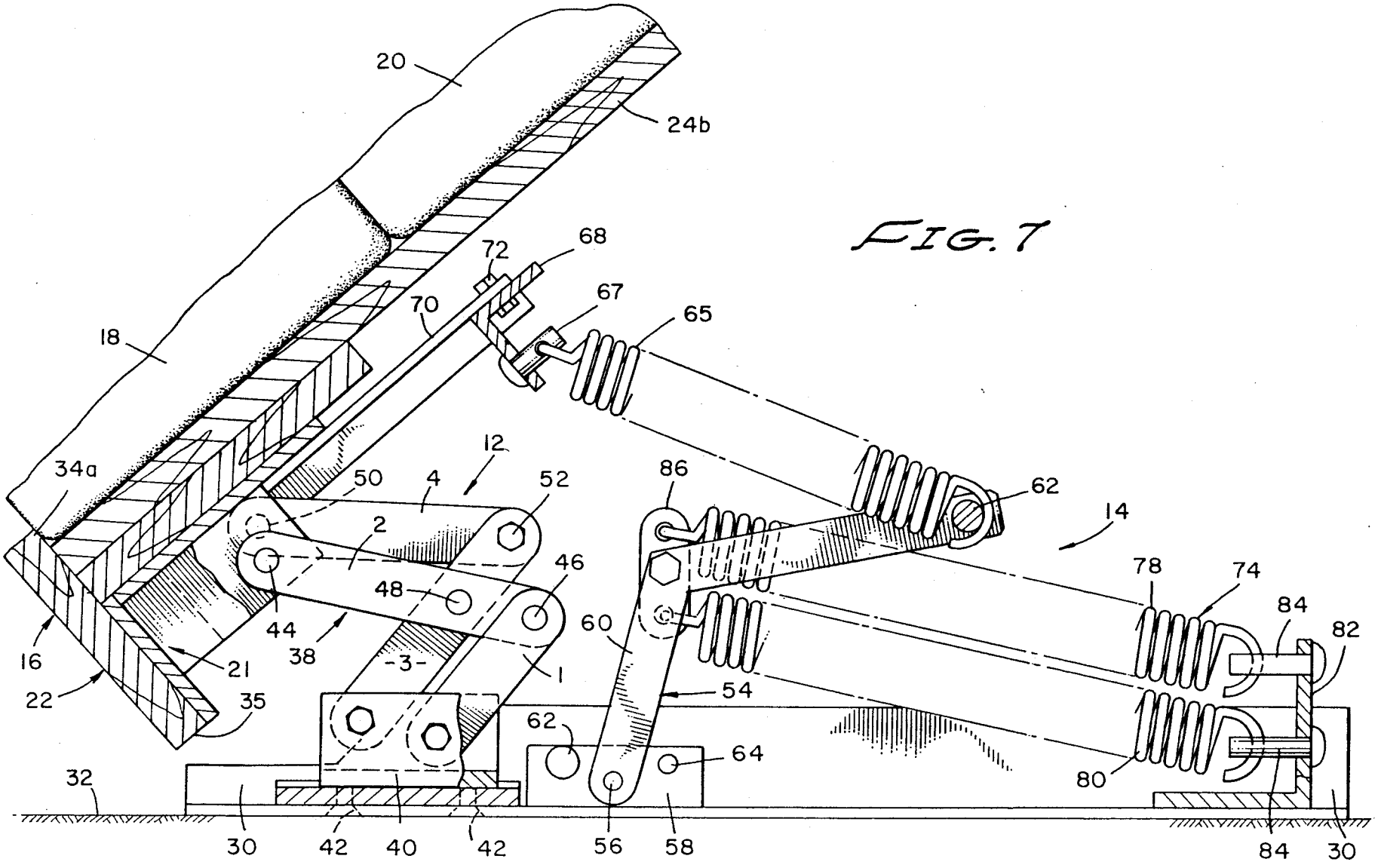
FIG. 7 is an enlarged, cross-sectional fragmentary view showing the linkage and counter balancing spring assemblies as the wall bed is being opened or closed.
Figure 10:
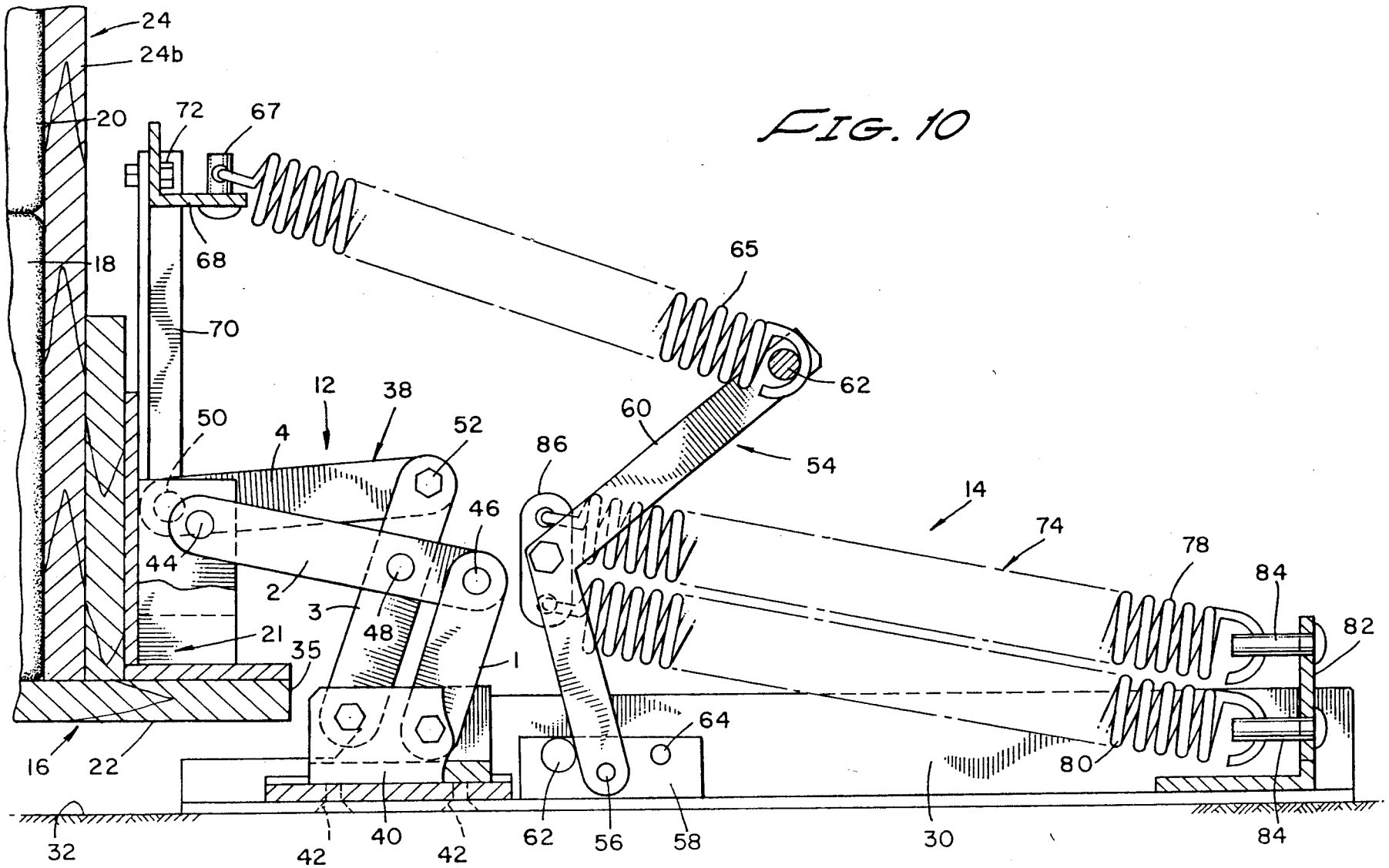
FIG. 10 is an enlarged, fragmentary view showing the linkage and counter balancing spring assemblies with the bed in the fully opened position.

For the purpose of providing a high degree of rigidity and load carrying capacity the linkage assembly 12 includes two essentially identical sets of lever mechanisms 38 and 38'. As best shown in FIGS. 3, 4 and 5, each linkage mechanism 38 and 38' includes four lever arms identified, respectively, as 1, 2, 3 and 4. Lever arms 1 and 3 are connected pivotably at one end to a pair of mounting blocks 40 secured by screws 42 to the mounting frame 30. The lever arms 1 and 3 are generally parallel to each other with lever arm 2 extending crosswise with respect to lever arms 1 and 3. The lever arm 2 has one end pivotably connected by a swivel pin 44 to the bracket assembly 21 and its opposed end connected by a swivel pin 46 to the free end of lever arm 1. A connecting rod 48 passes through the lever arms 2 and 3 of the one lever mechanism 38 and connects this mechanism to the complimentary lever mechanism 38' as illustrated in FIGS. 3 and 5. The lever arm 4 has one end connected to the bracket assembly 21 positioned slightly above the lever arm 2 through a swivel pin 50 and has its other end connected by a connecting rod 52 to the free end of lever arm 3. Connecting rod 52 also couples the lever mechanism 38 to the lever mechanism 38'. Thus, when the wall bed 10 is opened and closed, the four lever arms 1–4 move in unison as depicted in FIGS. 4, 7 and 10.

Figure 11:
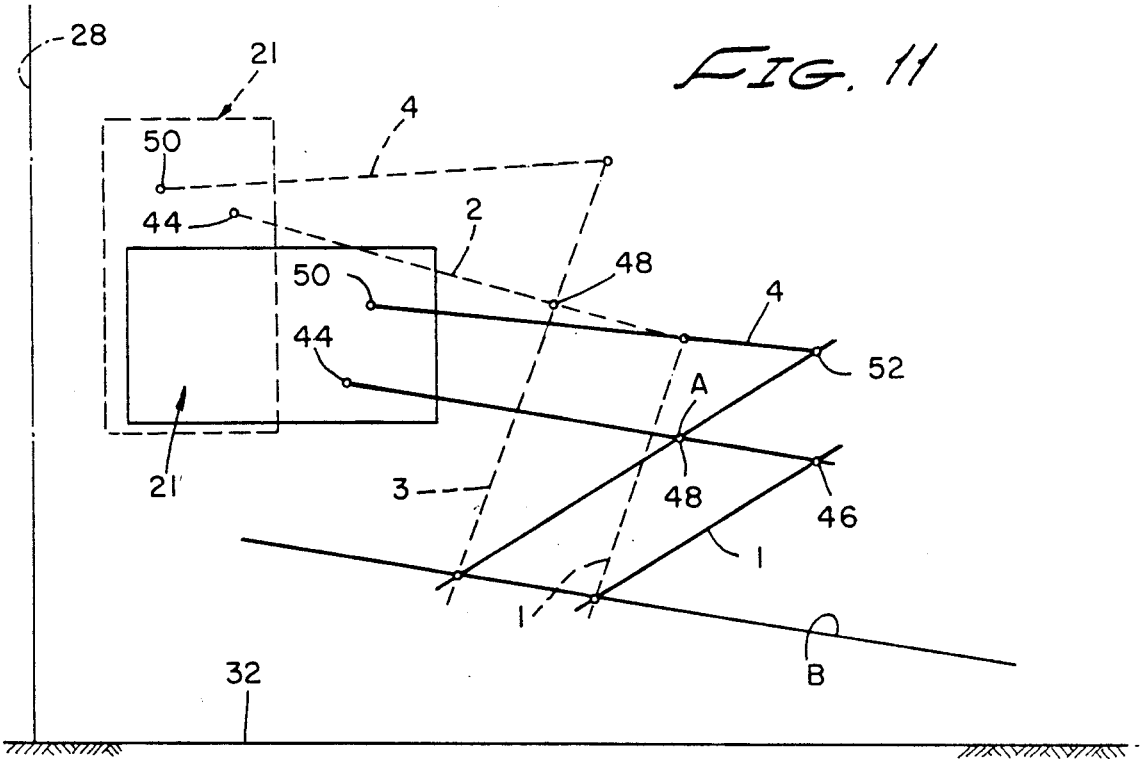
FIG. 11 is a schematic diagram illustrating the movement of the lever arms of the linkage assembly.

In accordance with this invention, the linkage assembly 12 provides three functions. One, it lifts the bed base 16. Two, it rotates the bed base 16 through a 90 degree turn. Three, it moves the bed base 16 forward. If a conventional hinge were employed, these three functions would not occur and the sleeping surface of the mattress 20 would not be moved completely from the wall cavity nor be elevated to the desired height above the floor 32. These functions, as illustrated in FIG. 11, occur as the lever arms 1–4 move between a folded, closed position as shown in FIG. 4 to a completely open position in FIG. 10. Lever arm 1 is shorter than lever arm 3 and lever arm 2 is pivotably connected at point A and aligned with line B in parallel to define the sides of a parallelogram. As the linkage assembly 12 opens and closes, the angles of the parallelogram change, but the parallel relationship of the lever arms 1 and 3 remains. Lever arm 4 changes its angular relationship with lever arm 2 as the wall bed 10 opens. The lengths of the lever arms 1–4 are adjusted to move the wall bed 10 to the position desired. Specifically, the most desirable position in the open position is with the headboard 24 immediately adjacent but outside of the wall cavity 28, moving the sleeping surface of the mattress 20 entirely beyond the wall cavity, and with the sleeping surface between about 19 and about 21 inches above the floor 32. In the closed position, the underside of the supporting member 34*a* will be flush with the wall closing the open entryway of the wall cavity 28 and the end portion 35 just about touching the floor, typically about $\frac{3}{4}$ to about $1\frac{1}{2}$ inches above the floor 32.

The counter balancing spring assembly 14 as illustrated in FIGS. 3 and 4 includes an angle arm 54 pivotably mounted at one end by pins 56 to mounting blocks 58 secured to the mounting frame 30. The mounting blocks 58 have on their exterior faces two stop members 62 and 64 which limit the pivotal movement of the angle arm 54. The angle arm 54 is a two piece structure with two identical L-shaped members 60 and 60' (FIG. 3). The L-shaped members 60 and 60' are spaced apart with a post 62 connecting them so that they move in unison. Disposed between the pair of L-shaped members 60 and 60' are a pair of inner extension springs 64 and 66. The inner springs 64 and 66 each have one end hooked around the post 62 and the opposed end hooked into an eyelet bolt 67 connected to an angle iron frame 68 which is secured by a bolt 72 to a plate 70 that is part of the bracket assembly 21.

The counter balancing spring assembly 14 also includes two sets of outer springs 74 and 76. Each set 74 and 76 has two outer springs 78 and 80. Each spring 78 and 80 has one end connected to an L-shaped mounting plate 82 connected through eyelet bolts 84 with their opposed ends connected to a pivot plate 86 pivotably mounted at the bend of L-shaped members 60 and 60'. There are openings in plate 86 that permit the hooked ends of the coiled springs 78 and 80 to slip into the openings in the plate.

Figure 12A:
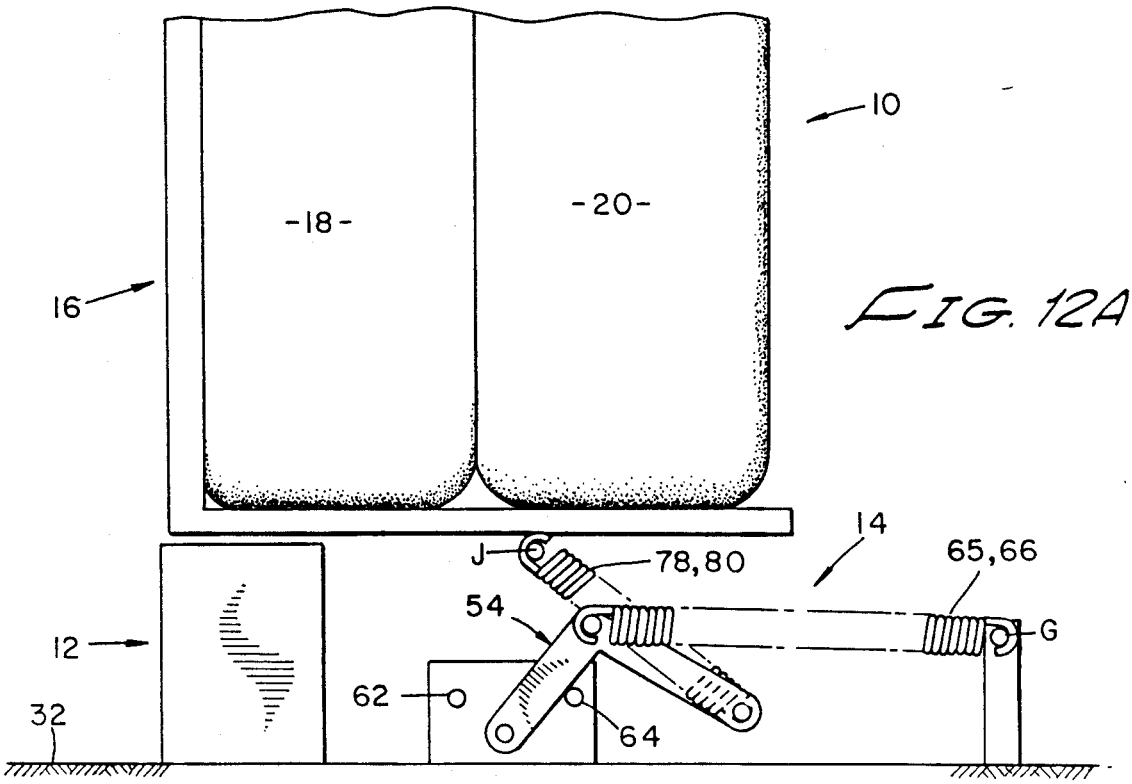
FIG. 12A is a simplified, diagramatic illustration of the counter balancing spring assembly in the closed position.
Figure 12B:
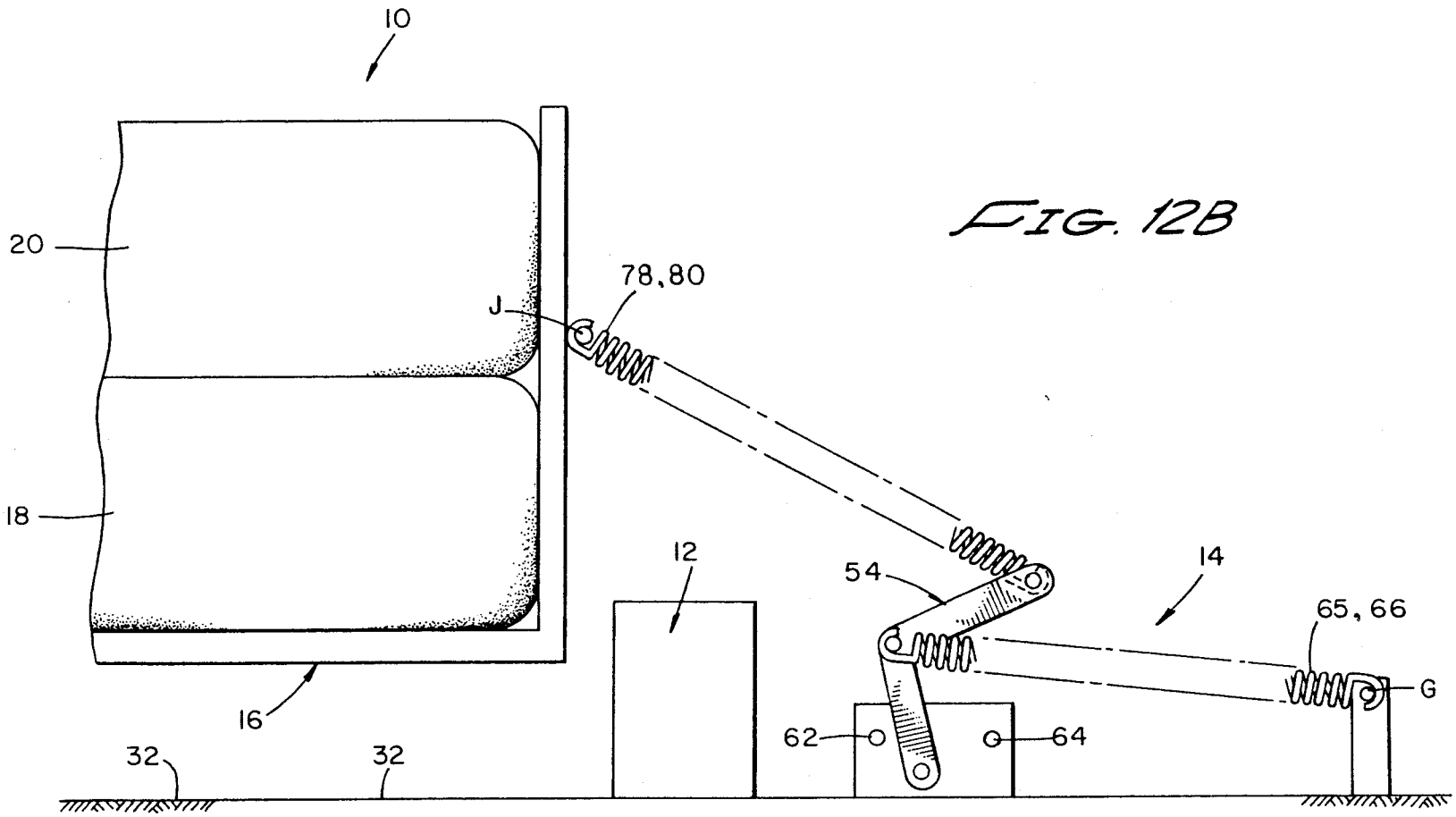
FIG. 12B is a simplified, diagramatic illustration of the counter balancing spring assembly similar to that shown in FIG. 12A showing the spring assembly in the open position.

The principal advantage of the counter balancing spring assemble 14 is that it fits into the confined space within the wall cavity. It deploys extension springs 64, 66, 78 and 80 so that they are in series rather than using one spring to extend between points J and G as illustrated schematically in FIGS. 12A and 12B. Ordinary extension springs would not be able to stretch between points J and G with the wall bed 10 in the open position as shown in FIG. 12B without exceeding their elastic limits. By using springs 64, 66, 78 and 80 in series and connected between points J and G through the angle arm 54, the elastic limits of those springs are not exceeded.

In accordance with another feature of this invention, the headboard 24 may be at a right angle with respect to the sleeping surface of the mattress 20 or tilted rearwardly as shown in FIG. 9. The headboard actuator 26 includes an adjustable arm 90. This arm has two holes 92 and 94 at its top end, and is connected to a position linkage 96 which couples the two sections 24*a* and 24*b* of the headboard together so that the section 24*a* is folded over and rests on the sleeping surface of the mattress when the wall bed 10 is closed. The arm 90 is coupled either through hole 92 or 94 to the elbow of a link 98 and to a support plate 100. The plate 100 has two positioning holes 102 and 104. As illustrated in FIGS. 8 and 9, the effective length of the arm 90 is either lengthened or shortened to position the headboard 24 so that it is at a right angle or tilted rearwardly upon opening of the wall bed 10.

OPERATION

The wall bed 10 will typically be in the closed, vertical position as illustrated in FIG. 1 with the balancing springs 64, 66, 78 and 80 of the counter balancing spring assembly 14 being undeflected and only at a slight initial tension. FIGS. 3 and 4 show the springs 64, 66, 78 and 80 in this position. The lever arms 1, 2, 3 and 4 of the linkage assembly 12 are in the collapsed position as shown in FIG. 4.

To open the wall bed 10 the user grasps the wall bed, for example, at the projections 36 and pulls outwardly, causing the head end of the bed base 16 to pivot. As the wall bed 10 moves from the closed to the open position, the extension springs 64, 66, 78 and 80 are placed in tension as illustrated in FIG. 7, and the linkage assembly 12 unfolds with the lever arms 1, 2, 3 and 4 opening up. Note that the lever arms 1 and 3 maintain a generally parallel position as they pivot about their respective ends. The connecting rod 48 connecting lever arm 2 to lever arm 3 causes all four lever arm 1, 2, 3 and 4 to move in unison. The lever arms 2 and 4 push the head end outwardly. As a consequence, when the wall bed 10 is in the horizontal position, the bed is moved outwardly from the wall cavity 28. As the bed moves to the horizontal position, the L-shaped members 60 and 60' of the angle arm 54 engage the one stop 62, preventing further movement of this lever arm in a counterclockwise direction as viewed in FIG. 10.

To close the bed, the user simply grasps the foot end of the wall bed 10 and pushes it upwardly. Since wall beds 10 are typically very heavy structures, the springs 64, 66, 78 and 80 now assist the user in overcoming the weight of the bed as it is tilted inwardly toward the wall cavity 28. The stops 58 limit the movement of the angle arm 54 in the clockwise direction as viewed in FIG. 10.

SCOPE OF THE INVENTION

The above description presents the best mode contemplated of carrying out the present invention as depicted by the embodiment disclosed. The combination of features illustrated by this embodiment provides the desirable attributes of this invention. This invention is, however, susceptible to modifications and alternate constructions from the embodiment shown in the drawing and described above. Consequently, it is not the intention to limit it to the particular embodiment disclosed. On the contrary, the intention is to cover all modifications and alternate constructions falling within the scope of the invention and generally expressed by the following claims.

I claim:

1. A wall bed type assembly adapted to be mounted within a wall and pivoted at one end to move between a closed vertical position and an open horizontal position, said assembly including a bed base for holding a mattress, a mounting element within the wall, linkage means connecting the mattress support at said one end to the mounting element, said linkage element including a plurality of arm members which move the wall bed from the wall to position said one end beyond the wall and elevate the bed base to a predetermined height above the floor which generally is equal to the height of a conventional bed, and a pair of spring members, an angle arm having opposed ends and bent at an intermediate portion between said opposed ends to form an angle, said angle member pivotably mounted at one end to move between a pair of stop elements, and one spring member having one end connected to the bed base and the other end connected to the non-pivoted end of the angle member, and the other spring member having one end connected to the mounting element and the other end connected to the angle member at said intermediate portion.

2. The wall bed type assembly of claim 1 wherein the linkage means includes a pair of pivotably mounted lever arms that are parallel to each other and coupled together to move in unison and maintain said parallel relationship.

3. The wall bed type assembly of claim 1 including a headboard having two sections, means for folding one of the headboard sections so that it lies on the sleeping surface of the mattress upon moving the wall bed to the closed position and for unfolding said one section to position said one section either at a right angle with respect to the sleeping surface of the mattress or tilted rearwardly with respect to said sleeping surface.

4. A wall bed type assembly adapted to be mounted within a wall and pivoted at one end to move between a closed vertical position and an open horizontal position, said assembly including a bed base for holding a mattress, a mounting element within the wall, and a counter balancing spring assembly connected between the bed base at one end and the mounting element, said counter balancing spring assembly including a pair of spring members, an angle arm having opposed ends and bent at an intermediate portion between said opposed ends to form an angle, said angle member pivotably mounted at one end to move between a pair of stop elements, and one spring member having one end connected to the bed base and the other end connected to the non-pivoted end of the angle member, and the other spring member having one end connected to the mounting element and the other end connected to the angle member at said intermediate portion.

5. The wall bed type assembly of claim 4 wherein the spring members are positioned relative to each other in series.

6. The wall bed type assembly of claim 5 including linkage means connecting the mattress support at said one end to the mounting element, said linkage element including a plurality of arm members which move beyond the wall and elevate the bed base to a predetermined height above the floor which generally is equal to the height of a conventional bed.

7. The wall bed type assembly of claim 6 wherein the linkage means includes a pair of pivotably mounted lever arms that are parallel to each other and coupled together to move in unison and maintain said parallel relationship.

8. The wall bed type assembly of claim 7 including a headboard having two sections, means for folding one of the headboard sections so that it lies on the sleeping surface of the mattress upon moving the wall bed to the closed position and for unfolding said one section to position said one section either at a right angle with respect to the sleeping surface of the mattress or tilted rearwardly with respect to said sleeping surface.

9. A wall bed type assembly to be mounted within a wall and pivoted at one end to move between a closed vertical position and an open horizontal position, said assembly including a bed base for holding a mattress, a headboard having two sections, means for folding one of the headboard sections so that it lies on the sleeping surface of the mattress upon moving the wall bed to the closed position and for unfolding said one section to position said one section either at a right angle with respect to the sleeping surface of the mattress or tilted rearwardly with respect to said sleeping surface, said means for folding and unfolding the headboard including a rigid arm adapted to be attached and detached to the means for folding and unfolding the headboard at different connection sites to change the effective length of the arm to thereby control the angular relationship of said one section to the sleeping surface.

* * * * *